US008087744B2

(12) United States Patent
Nakagawa et al.

(10) Patent No.: US 8,087,744 B2
(45) **Date of Patent: *Jan. 3, 2012**

(54) INK JET PRINTING APPARATUS

(75) Inventors: Yohinori Nakagawa, Kawasaki (JP); Naoji Otsuka, Yokohama (JP); Osamu Iwasaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 363 days.

This patent is subject to a terminal disclaimer.

(21) Appl. No.: 12/178,948

(22) Filed: Jul. 24, 2008

(65) Prior Publication Data

US 2008/0278555 A1 Nov. 13, 2008

Related U.S. Application Data

(62) Division of application No. 11/052,026, filed on Feb. 8, 2005, now Pat. No. 7,556,339.

(30) Foreign Application Priority Data

Feb. 12, 2004 (JP) ..... 2004-035802

(51) Int. Cl.
*B41J 2/15* (2006.01)
*B41J 2/175* (2006.01)
*B41J 2/17* (2006.01)

(52) U.S. Cl. ..... 347/21; 347/85; 347/96

(58) Field of Classification Search ..... 347/21, 347/85, 96, 89, 84, 94, 101, 105, 103, 88, 347/99

See application file for complete search history.

(56) References Cited

U.S. PATENT DOCUMENTS

| | | | | | |
|---|---|---|---|---|---|
| 4,432,003 | A | * | 2/1984 | Barbero et al. | 347/55 |
| 4,464,668 | A | * | 8/1984 | Komai et al. | 347/89 |
| 4,502,055 | A | * | 2/1985 | Horike et al. | 347/92 |
| 4,949,667 | A | * | 8/1990 | Yoshida et al. | 118/60 |
| 5,132,706 | A | * | 7/1992 | Yuasa et al. | 346/140.1 |
| 5,481,284 | A | * | 1/1996 | Kitahara et al. | 347/42 |
| 5,644,350 | A | | 7/1997 | Ando et al. | 347/101 |
| 5,760,808 | A | * | 6/1998 | Wiedemer | 347/103 |
| 5,818,485 | A | * | 10/1998 | Rezanka | 347/89 |
| 5,963,237 | A | | 10/1999 | Ikkatai et al. | 347/85 |
| 6,059,407 | A | * | 5/2000 | Komatsu et al. | 347/103 |
| 6,068,372 | A | * | 5/2000 | Rousseau et al. | 347/103 |
| 6,174,055 | B1 | | 1/2001 | Sugikubo et al. | 347/89 |
| 6,183,079 | B1 | * | 2/2001 | Meade et al. | 347/101 |
| 6,318,853 | B1 | | 11/2001 | Asano et al. | 347/103 |
| 6,341,854 | B1 | | 1/2002 | Takemoto | 347/96 |
| 6,402,317 | B2 | | 6/2002 | Yanagawa et al. | 347/104 |
| 6,494,570 | B1 | * | 12/2002 | Snyder | 347/103 |

(Continued)

FOREIGN PATENT DOCUMENTS

| | | | |
|---|---|---|---|
| JP | 56075867 | A * | 6/1981 |
| JP | 06008465 | A * | 1/1994 |
| JP | 8-58069 | | 3/1996 |

(Continued)

*Primary Examiner* — Stephen Meier
*Assistant Examiner* — Leonard S Liang
(74) *Attorney, Agent, or Firm* — Fitzpatrick, Cella, Harper & Scinto

(57) ABSTRACT

For a liquid applying mechanism of an ink jet printing apparatus, a liquid to be used for application to a medium is prevented from evaporating and leaking from a liquid holding member. An applying roller and the liquid holding member contact with each other to hold the liquid and apply the held liquid to a printing medium by way of the applying roller. In this configuration, the surface of the applying roller has no irregularities. Thereby, the applying roller can contact the liquid holding member to form an adequate liquid-tight seal therebetween.

7 Claims, 20 Drawing Sheets

U.S. PATENT DOCUMENTS

| | | | | |
|---|---|---|---|---|
| 6,585,364 | B2 | 7/2003 | Kasperchik et al. | 347/98 |
| 7,105,203 | B1 * | 9/2006 | Masuda et al. | 427/286 |
| 7,270,409 | B2 | 9/2007 | Iwasaki et al. | |
| 7,395,778 | B2 | 7/2008 | Iwasaki et al. | |
| 7,896,966 | B2 * | 3/2011 | Masuyama et al. | 118/600 |
| 2002/0075370 | A1 | 6/2002 | Szlucha | 347/101 |
| 2005/0178323 | A1 | 8/2005 | Iwasaki et al. | |

FOREIGN PATENT DOCUMENTS

| | | |
|---|---|---|
| JP | 8-72227 | 3/1996 |
| JP | 2000-246876 | 9/2000 |
| JP | 2001-70858 | 3/2001 |
| JP | 2002-96452 | 4/2002 |
| JP | 2002-517341 | 6/2002 |
| WO | WO 99/64243 | 12/1999 |

* cited by examiner

INK JET PRINTING APPARATUS

This application is a division of U.S. patent application Ser. No. 11/052,026, filed Feb. 8, 2005.

BACKGROUND OF THE INVENTION

1. Field of the Invention

The present invention relates to an ink jet printing apparatus having a mechanism that applies the liquid to a print medium used for ink jet printing, for a predetermined purpose, for example, for starting the coagulation of pigments earlier when printing is carried out using inks composed of the pigments as color materials.

2. Description of the Related Art

In the field of ink jet printing apparatuses, those using a liquid applying mechanism are known. Japanese Patent Application Laid-open No. 2002-517341 describes an apparatus which uses a doctor blade contacting with a roller and in which the application liquid is collected between the blade and the roller so that the application liquid is applied to the roller as the roller rotates. As the roller rotates, the application liquid applied to the roller is transferred and applied to a support conveyed between this roller and another roller. Japanese Patent Application Laid-open No. 08-072227 (1996) similarly discloses a mechanism in an ink jet printing apparatus which applies a treatment liquid before printing which liquid insolubilizes dyes. In Embodiment 1 of this document, the treatment liquid in a replenishing tank is pumped by being attached to the rotating roller. At the same time, the treatment liquid pumped is applied to print paper.

However, in the configurations described in the above patent documents, an application liquid is applied or supplied to the surface of the rod bar or roller. However, the part of the rod bar or roller to which the application liquid is applied or supplied is open to or in communication with the air. Thus, disadvantageously, the application liquid may be evaporated or, for example, the application liquid may leak when the posture of the apparatus is changed. In particular, with an ink jet printing apparatus such as a printer, in view of, for example, the leakage of the liquid caused by a change in the posture of the apparatus, it is difficult to apply the applying mechanism described in the above documents to the apparatus if its size has been reduced.

In contrast, Japanese Patent Application Laid-open No. 08-058069 (1996) discloses a configuration that seals a part that applies or supplies inks, that is, application liquids, to a roller.

The applying mechanism described in this document operates in a gravure printing apparatus to apply inks to a roller (applying roller) having the surface of which formed with a pattern of a printing plate. This mechanism uses an ink chamber having two doctor blades arranged at two vertical positions along a peripheral surface of the roller and extending in a longitudinal direction of the roller and elastic members provided at the opposite sides of the two doctor blades. The chamber is contacted with the peripheral surface of the roller to form a liquid chamber between the ink chamber and the roller. Then, the roller is rotated to apply or supply the application liquid from the liquid chamber to the roller.

However, a sealing structure disclosed in Japanese Patent Application Laid-open No. 08-058069 (1996) may not have a sufficient sealing performance. More specifically, a roller in Japanese Patent Application Laid-open No. 08-058069 (1996) is formed with patterns for gravure printing, and thus the surface of the roller has irregularities. Consequently, ink may evaporate through this irregular portion and specifically ink may leak through the irregular portion at the time when the rotation of the roller is stopped.

Further, if the roller used in the gravure printing, which is disclosed in Japanese Patent Application Laid-open No. 08-058069 (1996), is employed as an applying roller for applying a liquid in an ink jet printing apparatus, the applying liquid is not applied uniformly due to the irregularities of the applying roller, and thus unevenness of application on a printing medium occurs. Then, if ink jet printing is performed to the printing medium on which the unevenness of application has occurred, the unevenness of the application affects an eventually obtained image to form the image having unevenness. Accordingly, it may be difficult to employ the applying structure in Japanese Patent Application Laid-open No. 08-058069 (1996) as the applying structure used in the ink jet printing apparatus, also in view of an image quality obtained.

SUMMARY OF THE INVENTION

The present invention can provide an ink jet printing apparatus having a mechanism that applies a predetermined liquid to a print medium using an applying member, whose applying surface rotates, such as an applying roller.

In the first aspect of the present invention, there is provided an ink jet printing apparatus for printing an image on a printing medium by ejecting an ink from a print head, the apparatus comprising:

applying means for applying a predetermined liquid to the printing medium; and printing means for causing the print head to eject the ink to the printing medium, to which the predetermined liquid has been applied by the applying means, wherein the applying means has an applying member including an applying surface, which is used for applying the predetermined liquid to the print medium, and has substantially no irregularities, and a holding member contacting with the applying surface of the applying member so as to form a liquid holding space for holding the predetermined liquid, and applies the predetermined liquid held in the liquid holding space to the print medium through the applying surface by rotating the applying surface.

In the second aspect of the present invention, there is provided an ink jet printing apparatus for printing an image on a printing medium by ejecting an ink from a print head, the apparatus comprising:

applying means for applying a predetermined liquid to the printing medium; and printing means for causing the print head to eject the ink to the printing medium, to which the predetermined liquid has been applied by the applying means, wherein the applying means has an applying member including an applying surface, which is used for applying the predetermined liquid to the print medium and has substantially no irregularities, and a holding member contacting with the applying surface of the applying member so as to form a liquid holding space for holding the predetermined liquid, and applies the predetermined liquid held in the liquid holding space to the print medium through the applying surface by rotating the applying surface, and wherein the applying surface of the applying member is provided no patterns of an image to be printed with the ink.

In the third aspect of the present invention, there is provided an apparatus that prints an image to a print medium, the apparatus comprising:

applying means for applying a predetermined liquid to the print medium; and printing means for printing the image to the printing medium, to which the predetermined liquid has been applied by the applying means, wherein the applying means has an applying member including an applying surface, which is used for applying the predetermined liquid to the print medium and has substantially no irregularities, and a holding member contacting with the applying surface of the applying member so as to form a liquid holding space for holding the predetermined liquid, and applies the predetermined liquid held in the liquid holding space to the print medium through the applying surf ace by rotating the applying surface.

In the fourth aspect of the present invention, there is provided an apparatus that prints an image to a print medium, the apparatus comprising:

applying means for applying a predetermined liquid to the print medium; and printing means for printing the image to the printing medium, to which the predetermined liquid has been applied by the applying means, wherein the applying means has an applying member including an applying surface, which is used for applying the predetermined liquid to the print medium and has substantially no irregularities, and a holding member contacting with the applying surface of the applying member so as to form a liquid holding space for holding the predetermined liquid, and applied the predetermined through the applying surface by rotating the applying surface, and wherein the applying surface of the applying member is provided no patterns of an image to be printed.

With the above described configuration, since the applying member, whose applying surface rotates as an applying roller to apply the applying liquid to the printing medium, substantially has no irregularities on its applying surface, a predetermined coat can be uniformly formed on the printing medium, and the applying member can contact with the liquid holding member to form an adequate liquid-tight seal therebetween. Consequently, printing that employs the applying liquid can be well performed and the liquid held by the liquid holding member is prevented form vaporizing and leaking with certainty.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Preferred embodiments of the present invention will be described below in detail with reference to the accompanying drawings.

Figure 1:
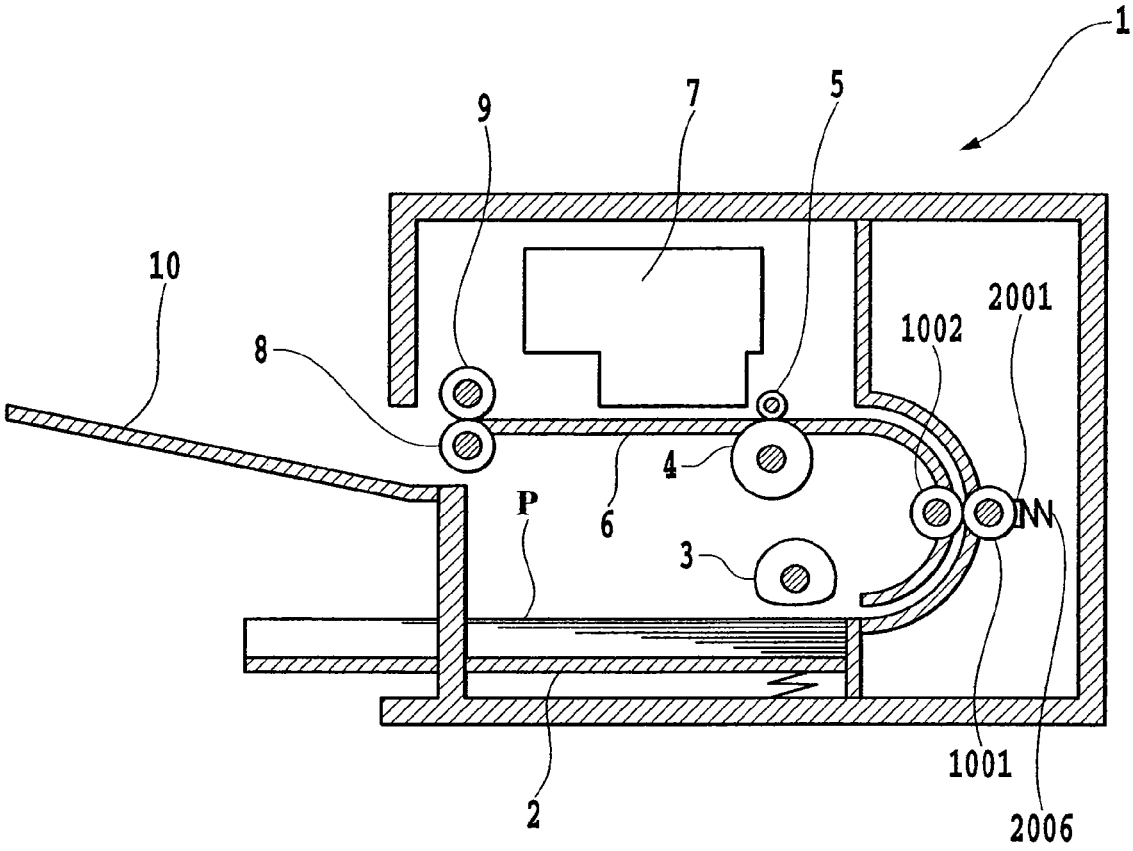
FIG. 1 is a vertical side view generally showing the configuration of an ink jet printing apparatus according to the embodiment of the present invention.

FIG. 1 is a diagram generally showing the configuration of an ink jet printer as one embodiment of ink jet printing apparatus according to the present invention. The ink jet printer of this embodiment is provided with a liquid applying mechanism for applying a liquid to a printing medium such as a printing sheet.

The ink jet printing apparatus 1 is provided with a feeding tray 2 on which a plurality of print media P are stacked. A semicircular separating roller 3 separates each print medium P from the others stacked on the feeding tray and then feeds it to a conveying path. The applying roller 1001 and the counter roller 1002 are arranged in the conveying path; the applying roller 1001 and the counter roller 1002 constitute liquid applying means of the liquid applying mechanism. The print medium P fed from the feeding tray 2 is then fed to between the rollers 1001 and 1002. The applying roller 1001 is rotated clockwise in FIG. 1 by the rotation of a roller driving motor. The applying roller 1001 applies the application liquid to a print surface of the print medium P while conveying the print medium P. A surface (peripheral surface) of the applying roller 1001 is not formed with patterns of an image that is printed with ink as in a gravure printing disclosed in Japanese Patent application Laid-open No. 08-58069 and is formed with no image patterns. The surface of the applying roller 1001 has substantially no irregularities. In this regard, in the strict sense, the applying roller has not completely non-irregular surface, and has the surface with minute irregularities as described with reference to FIGS. 15-17. However, these irregularities are of that caused according to an accuracy of a surface treatment and a manufacturing error. The present invention is applicable to any roller which can apply the applying liquid to the printing medium uniformly. The surface roughness (Ra) of such roller is equal to or smaller than 5.0, preferably equal to or smaller than 2.5. In addition, the surface roughness is measured by using a measurement technique defined in JIS B0601.

Herein, the; surface of the roller having the roughness equal to or smaller than 5.0 is called as "surface with substantially no irregularities" The print medium P to which the application liquid has been applied is fed to between a conveying roller 4 and a pinch roller 5. Then, the conveying roller 4 is rotated counterclockwise in the figure to convey the print medium P on a platen 6.

For the print medium P conveyed on the platen 6, printing is performed at a position opposite to a print head 7. More specifically, the print head 7 is of an ink jet type in which a predetermined number of nozzles for ink ejection are disposed. While the print head 7 is being scanned in a direction perpendicular to the sheet of the drawing, printing is carried out by ejecting ink droplets from the nozzles to the print surface of the print medium P in accordance with print data. An image is formed on the print medium by alternately repeating a printing operation and a conveying operation performed by the conveying roller 4 to convey the print medium by a predetermined amount. Simultaneously with this printing operation, the print medium P is sandwiched between a sheet discharging roller 8 and a sheet discharging spur 9 both provided downstream of the scan area of the print head in the conveying path for the print medium. The print medium P is then discharged onto a sheet discharging tray 10 by the rotation of the sheet discharging roller 8.

This ink jet printing apparatus may be constructed as what is called a full line type in which an elongate print head having nozzles from which inks are ejected and which are disposed over the maximum width of the print medium is used to perform a printing operation.

The application liquid used in the present embodiment is a processing liquid that is intended to facilitate the coagulation of pigments when printing has been carried out using inks including the pigments as color materials.

An example of the components of the application liquid is shown below.

Tetrahydrate of calcium nitrate: 10%

Glycerin: 42%

Surface active agent: 1%

Water: remaining amount

The application liquid has a viscosity of 5 to 6 cp (centipoise) at 25° C.

In applications of the present invention, of course, the application liquid is not limited to the one described above. For example, a liquid including a component which insolubilizes or coagulates a dye may be used as another application liquid.

This embodiment employs the processing liquid as the applying liquid to react the processing liquid with the pigments as a coloring material in the ink, which is ejected to a printing medium to which the processing liquid has been applied, and to facilitate coagulation of the pigments. The facilitating coagulation of the pigments can improve print density. Further, bleeding of ink can be also decreased or prevented. Of course, an applying liquid employed in the ink jet printing apparatus is not limited to the above processing liquid.

If water is used as a liquid to be applied, the slidability of the abutting portion between the applying roller and the liquid holding member according to the present invention is improved by containing a component that reduces surface tension in the liquid. In the above example of the components of the liquid to be applied, the glycerin and the surface active agent are components that reduce the surface tension.

Figure 2:
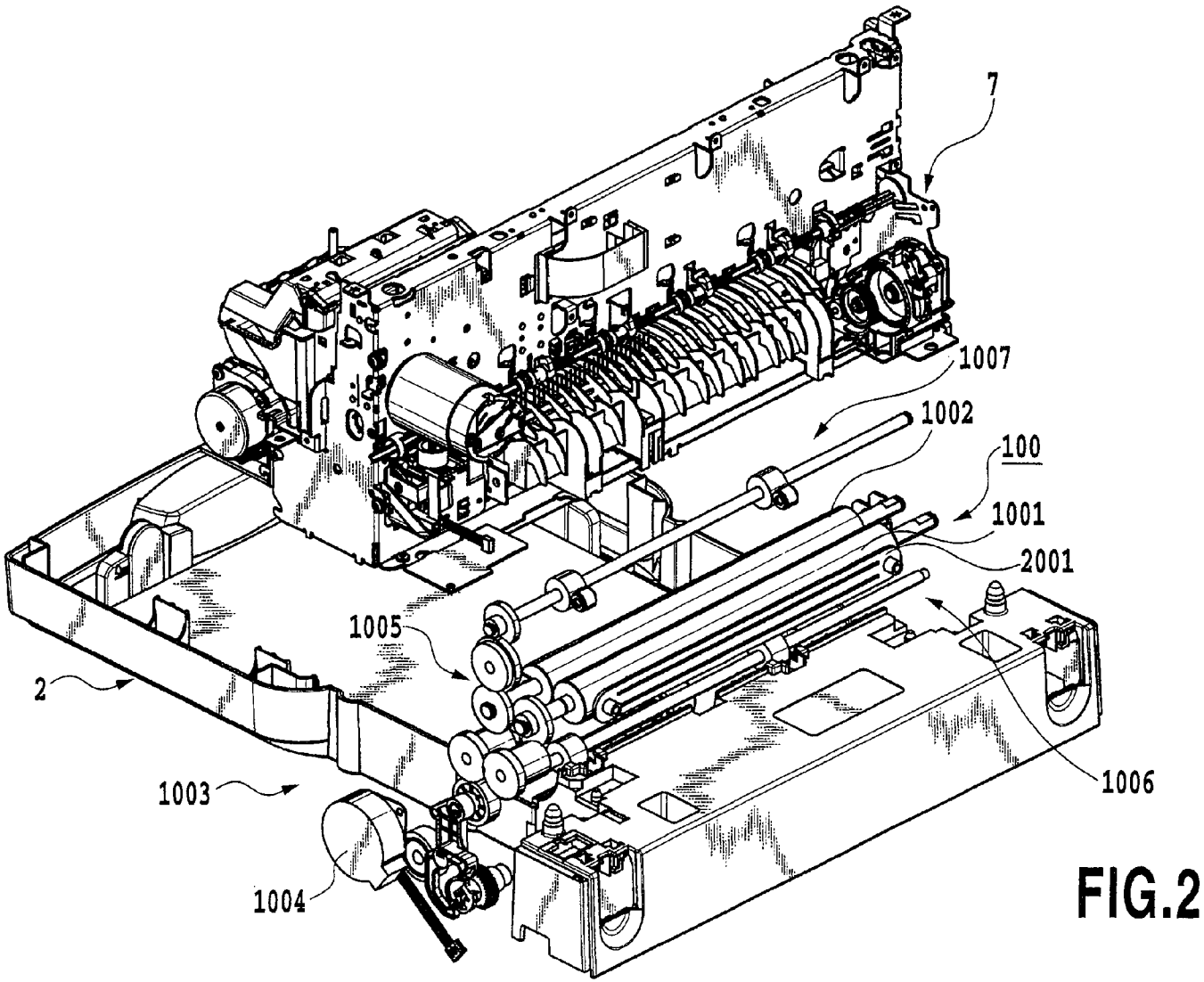
FIG. 2 is a perspective view mainly showing a printing mechanism and a liquid applying mechanism in an ink jet printing apparatus shown in FIG. 1.

FIG. 2 is a perspective view showing an essential part of the above ink jet printing apparatus. As shown in the figure, an applying mechanism 100 is provided above one end of the feeding tray 2. A printing mechanism comprising the print head 7 and the like is provided above the applying mechanism 100 and above a central portion of the feeding tray 2.

A liquid applying mechanism 100 roughly has a liquid applying mechanism for applying a predetermined application liquid to a printing medium and a liquid supplying mechanism for supplying the application liquid to the liquid applying mechanism.

As shown in FIG. 2, the liquid applying mechanism has a cylindrical applying roller 1001, a cylindrical counter roller (medium supporting member) 1002 placed opposite the applying roller 1001, and a roller driving mechanism 1003 that drives the applying roller 1001. The roller driving mechanism 1003 comprises a roller driving motor 1004 and a transmission mechanism 1005 which transmits the driving force of the roller driving motor 1004 to the applying roller 1001 and which has a gear train and the like.

The liquid supplying mechanism has a liquid holding member 2001 that holds the application liquid between the liquid holding member 2001 and a peripheral surface of the applying roller 1001, and a liquid channel 3000 (not shown in FIGS. 1 and 2) described later and through which the liquid is supplied to the liquid holding member 2001. The applying roller 1001 and the counter roller 1002 are rotatively movably supported by respective shafts which are parallel to each other and each of which has opposite ends rotatively movably attached to a frame (not shown). Further, the liquid holding member 2001 extends almost all along the applying roller 1001 in a longitudinal direction. The liquid holding member 2001 is movably attached to the frame via a mechanism that enables the liquid holding member 2001 to contact with and separate from the peripheral surface of the applying roller 1001.

As described with reference to FIG. 1, the printer of this embodiment is provided with a printing medium supply mechanism, which comprises a pickup roller and the like, for conveying the printing medium to a nip portion between the applying roller 1001 and the counter roller 1002. Further, on the down stream side of a location of the applying roller 1001 and the counter roller 1002 in the conveying path for the printing medium, a conveying mechanism 1007, which comprises a conveying roller 4 and the like, for conveying the printing medium to which the applying liquid has been applied through the printing mechanism. These supply mechanism and conveying mechanism is also operated with a driving force transmitted through driving force transmitting mechanism 1005, similarly to the applying roller.

Now, a detailed description will be given of the elements of the sections of the applying apparatus described above in brief.

Figure 3:
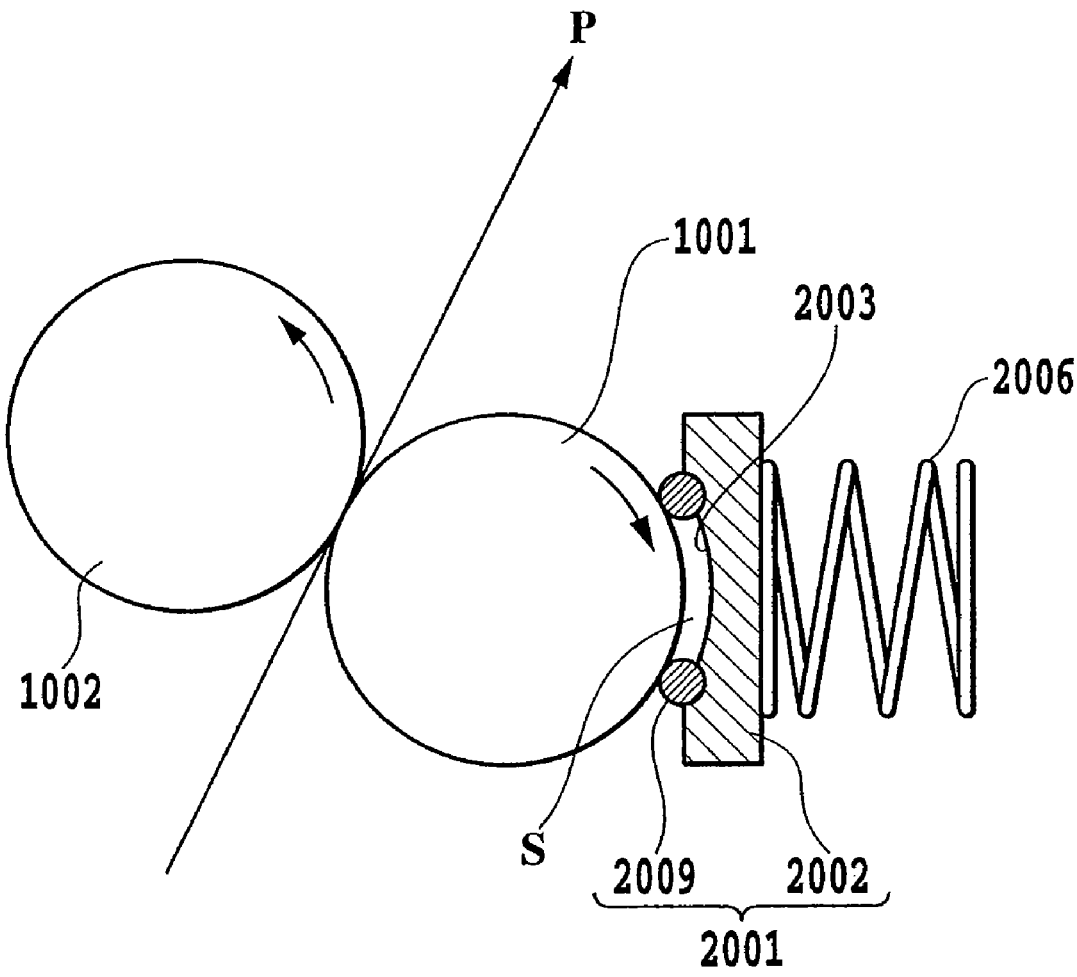
FIG. 3 is a vertical side view showing an example of the arrangement of an applying roller, a counter roller, and a liquid holding member which are shown in FIGS. 1 and 2.

FIG. 3 is a sectional view, as seen from the side, illustrating an example of the arrangement of an applying roller 1001, a counter roller 1002, a liquid holding member 2001 or the like.

The counter roller 1002 is biased by biasing means (not shown) toward the peripheral surface of the applying roller 1001. By rotating the applying roller 1001 clockwise in the figure, it is possible to sandwich a print medium P on which the application liquid is to be applied, between the rollers, while conveying the print medium P in the direction of an arrow in the figure.

Further, the liquid holding member 2001 is constructed by comprising a space forming base material 2002 and abutting member 2009, and is urged and abutted against the peripheral surface of the applying roller 1001 under the biasing force of a spring member 2006. The abutting of the liquid holding member 2001 causes an elongate liquid holding space S to be formed, which space extends (in a direction perpendicular to the drawing sheet of FIG. 3) all over an area applied the liquid by the applying roller 1001. The application liquid from a liquid channel 3000, described later, is supplied to the interior of the liquid holding space S via the liquid holding member 2001. In this case, since the liquid holding member 2001 is configured as described below, the application liquid can be prevented from inadvertently leaking from the liquid holding space S to the exterior while the applying roller 1001 is stopped.

FIGS. 4 to 9 show the configuration of the liquid holding member 2001.

Figure 4:
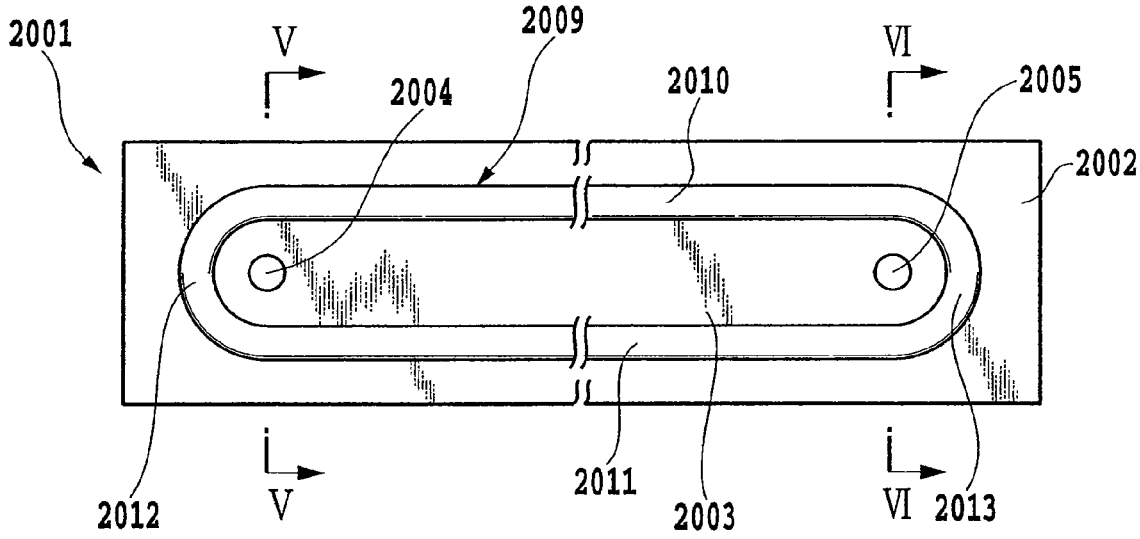
FIG. 4 is a front view of the liquid holding member shown in FIGS. 1 and 2.

As shown in FIG. 4, the liquid holding member 2001 has a space forming base material 2002 and an annular abutting member 2009 located on one surface of the space forming base material 2002. A concave portion 2003 is formed in a central portion of the space forming base material 2002 along its longitudinal direction; a bottom portion of the concave portion 2003 has a circular cross-section. The abutting member 2009 has linear portions 2010 2011 fastened along the upper and lower edges of the concave portion 2003 and circumferential portions 2012 2013 fastened so as to extend from the upper edge to the lower edge. Thus, when the abutting member 2009 of the liquid holding member 2001 abuts against the applying roller 1001, the abutment conforms to the shape of the peripheral surface of the applying roller. It is thus possible to achieve the abutment at a uniform pressure.

As described above, in the liquid holding member according to this embodiment, the abutting member 2009, formed integrally and seamlessly, is continuously abutted without a gap against the outer peripheral surface of the applying roller 1001 under the biasing force of the spring member 2006. As a result, the liquid holding space S is substantially closed by the abutting member 2009, one surface of the space forming base material, and the outer peripheral surface of the applying roller 1001. The liquid is held in this space. Then, when the rotation of the applying roller 1001 is stopped, the abutting member 2009 and the outer peripheral surface of the applying roller 1001 maintain a liquid tight state. The liquid can be reliably prevented from leaking to the exterior. On the other hand, when the applying roller 1001 is rotated, the application liquid can slipperily flow between the outer peripheral surface of the applying roller 1001 and the abutting member 2009 as described later. In this case, when the applying roller 1001 is stopped and the liquid tight state is established between the outer peripheral surface of the applying roller 1001 and the abutting member 2009, the liquid cannot flow out of the space as described above. In this case, the abutting state of the abutting member 2009 includes not only direct abutment against the outer peripheral surface of the applying roller 1001 but also abutment against the outer peripheral surface via a liquid film formed under a capillary force.

Figure 7:
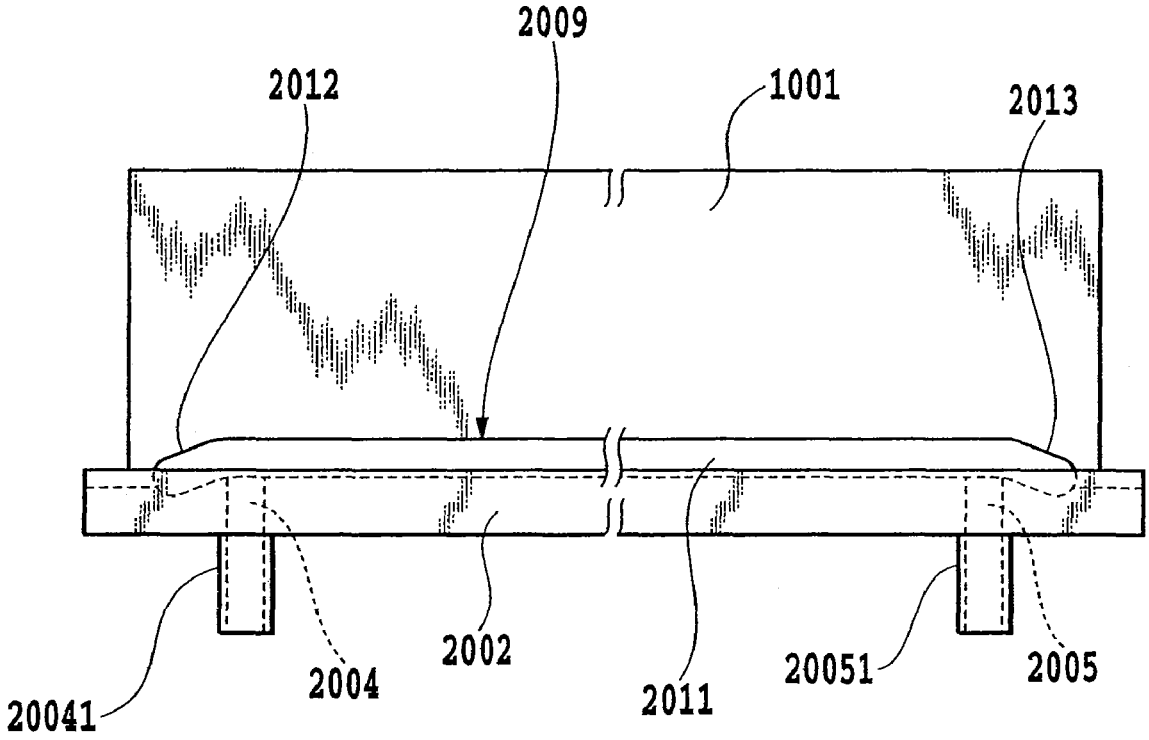
FIG. 7 is a plan view of the liquid holding member shown in FIG. 4.
Figure 8:
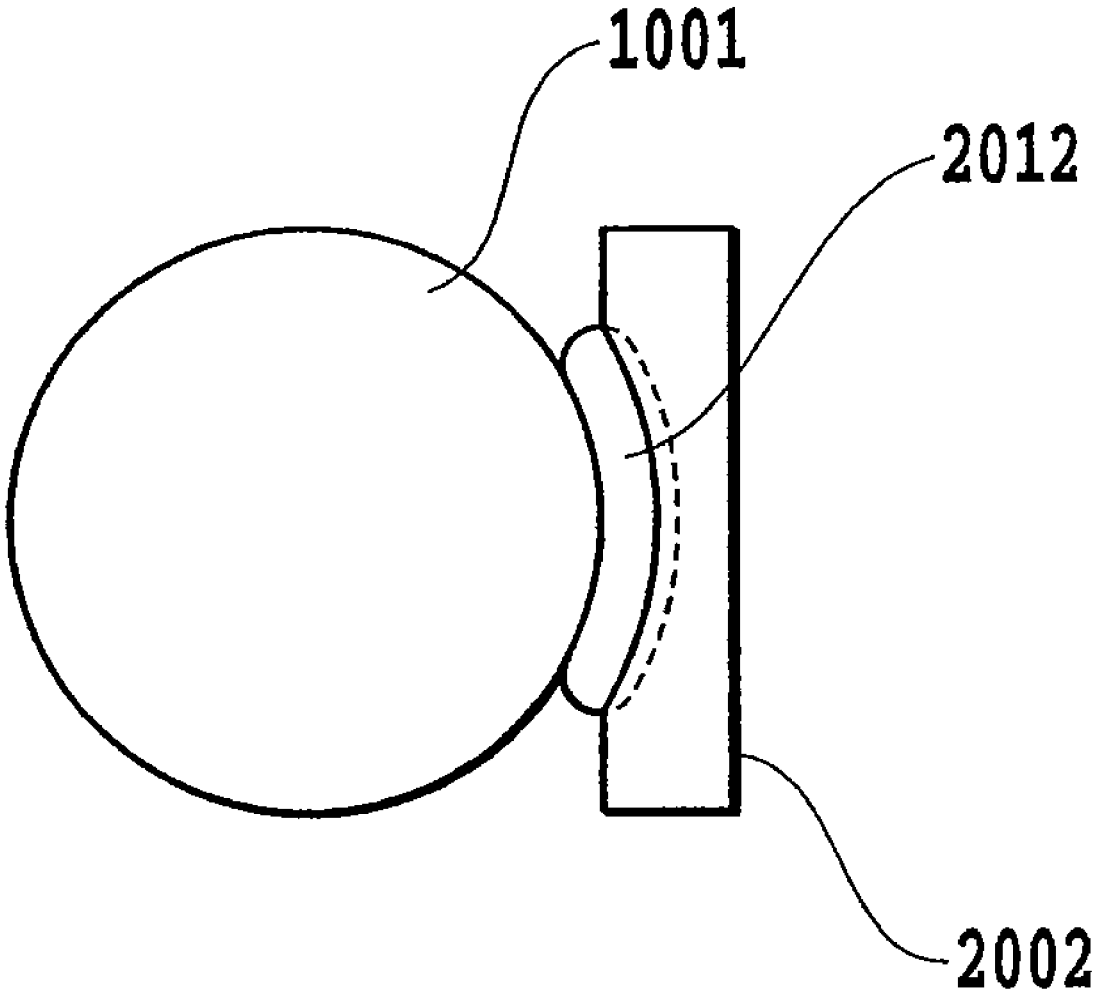
FIG. 8 is a left side view showing how an abutting portion of the liquid holding member shown in FIG. 4 is abutted against a liquid applying roller.
Figure 9:
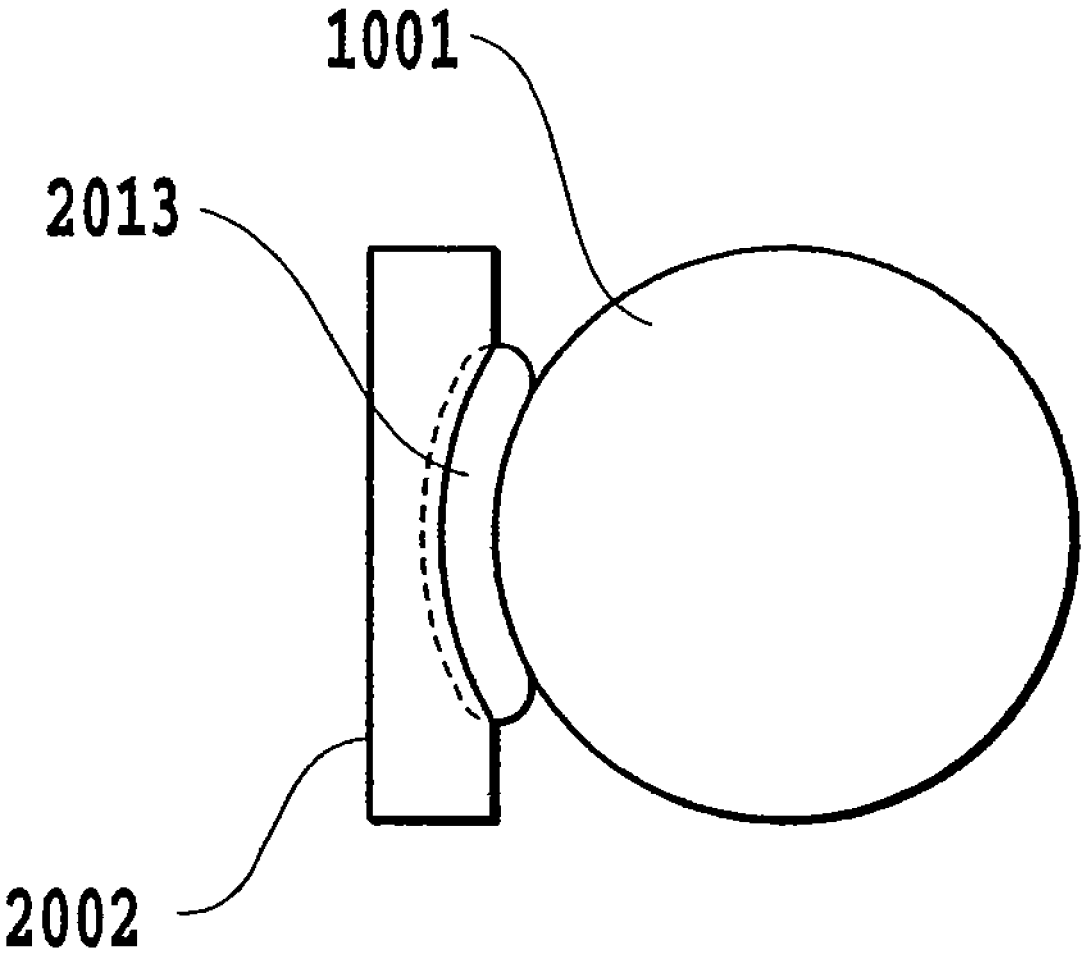
FIG. 9 is a right side view showing how the abutting portion of the liquid holding member shown in FIG. 4 is abutted against the liquid applying roller.

The longitudinally opposite sides of the abutting member 2009 are gently curved as viewed from its front (FIG. 4), from above (FIG. 7), or from its side (FIGS. 8 and 9). Thus, even when the abutting member 2009 is abutted against the applying roller 1001 under a relatively high pressure, the whole abutting member 2009 is substantially uniformly elastically deformed. This prevents large distortions locally. Thus, as shown in FIGS. 7 to 9, the abutting member 2009 abuts tightly without the gap against the outer peripheral surface of the applying roller 1001. As a result, a substantially closed space can be formed as described above.

Figure 5:
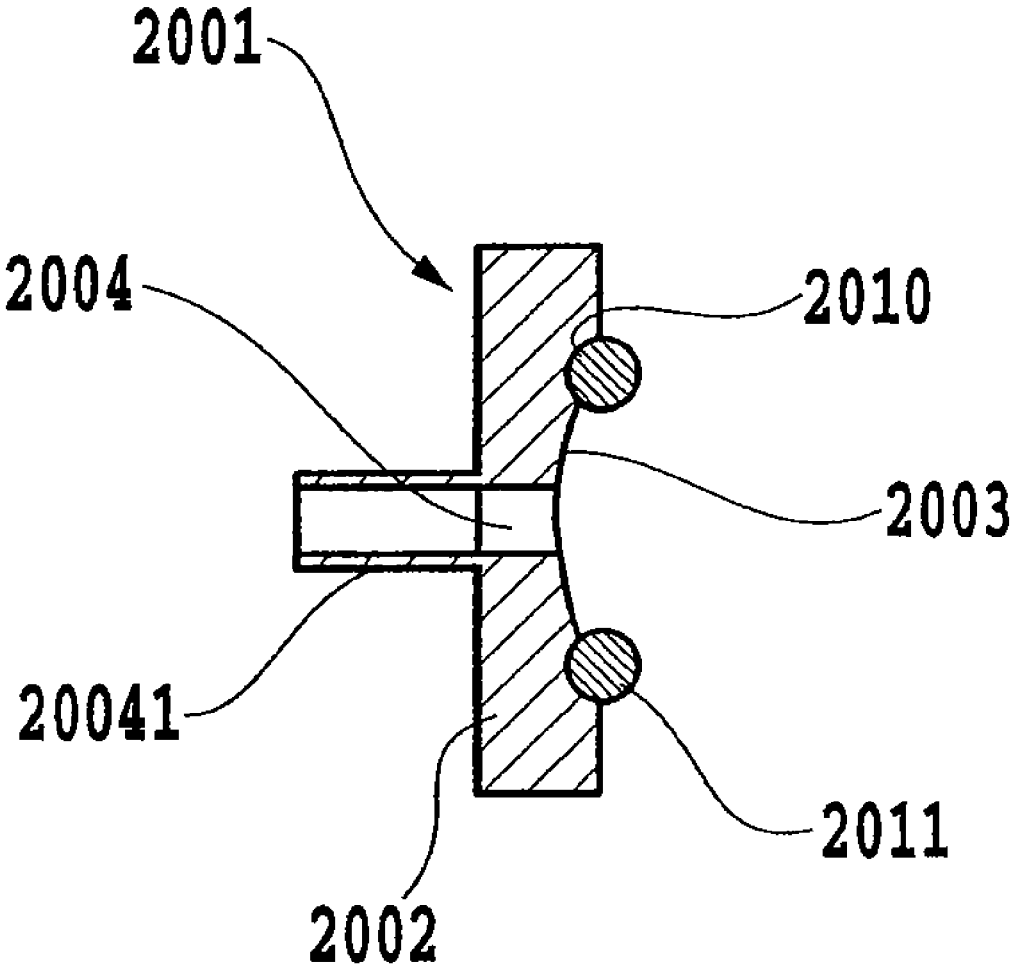
FIG. 5 is an end view showing an end surface of the liquid holding member shown in FIG. 4, the view taken along line V-V in FIG. 4.
Figure 6:
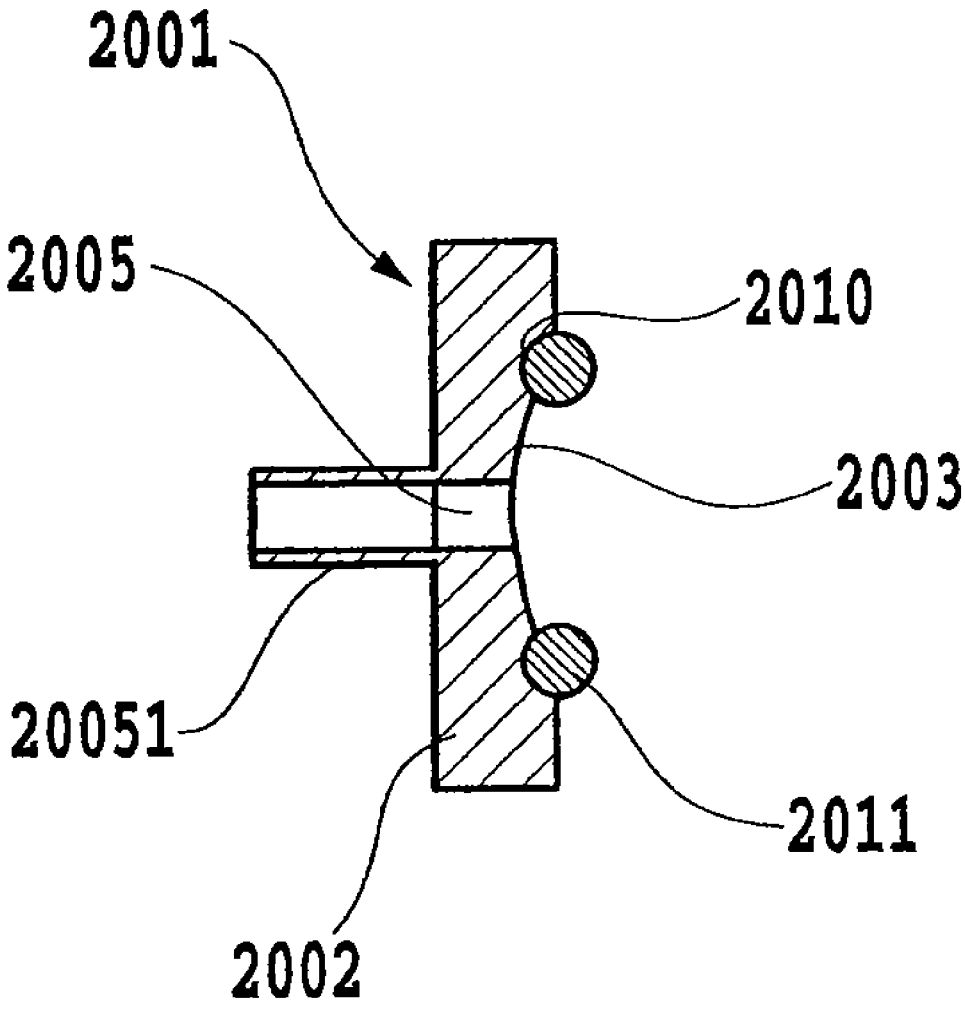
FIG. 6 is an end view showing the end surface of the liquid holding member shown in FIG. 4, the view taken along line VI-VI in FIG. 4.

On the other hand, as shown in FIGS. 4 to 6, a liquid supplying port 2004 and a liquid collecting port 2005 are formed in an area of the space forming base material 2002 which is surrounded by the abutting member 2009; the liquid supplying port 2004 and the liquid collecting port 2005 have holes penetrating the space forming base material 2002. The liquid supplying port 2004 and the liquid collecting port 2005 are communicating with cylindrical connecting portions 20041 and 20051 projected from a back surface of the space forming base material. Further, the connecting portions 20041 and 20051 are connected to a liquid channel 3000 described later. In this embodiment, the liquid supplying port 2004 is formed near one end of an area surrounded by the abutting member 2009 (the left end in FIG. 4), while the liquid collecting port 2005 is formed near the other end of the same area (the right end in FIG. 4). The liquid supplying port 2004 is used to supply the application liquid provided through the liquid channel 3000, to the liquid holding space S. The liquid collecting port 2005 is used to allow the liquid in the liquid holding space S to flow out to the liquid channel 3000. The supply and discharging of the application liquid allows the liquid to flow from the left end to right end of the liquid holding space S.

(Application Liquid Channel)

Figure 12:
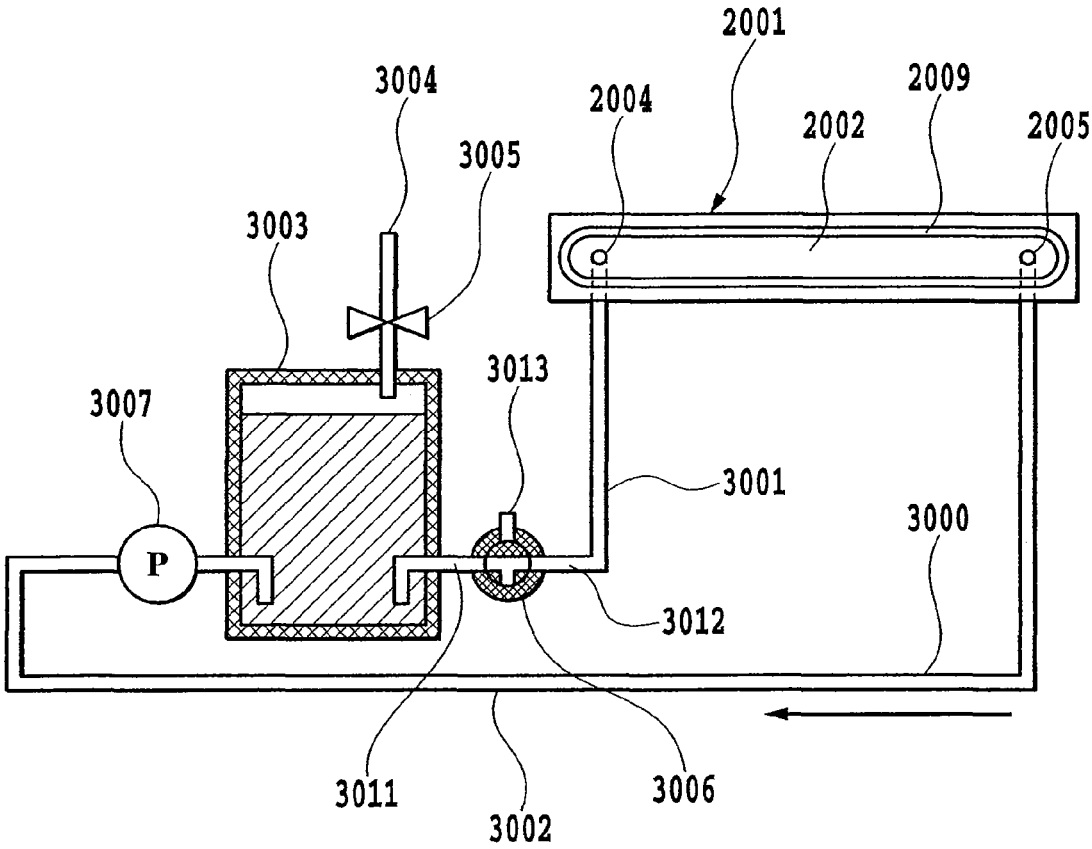
FIG. 12 is a diagram generally showing the configuration of a liquid channel in the liquid applying apparatus according to the embodiment of the present invention.

FIG. 12 is a diagram generally illustrating the configuration of the liquid channel 3000, connected to the liquid holding member 2001 of the application liquid supplying means.

The liquid channel 3000 has a first channel 3001 that connects the liquid supplying port 2004 of the space forming base member 2002, constituting the liquid holding member 2001, to a storage tank 3003 that stores the application liquid, a second channel 3002 that connects the liquid collecting port 2005 of the space forming base material 2002 to the storage tank 3003 together. An air communicating port 3004 is formed in the storage tank 3003. The air communicating port is provided with an air communicating valve 305 that switches between a communicating state for the air and a closed state for the same. The air communicating port 3004 desirably has a labyrinthine structure in order to inhibit evaporation. Further, the first channel 3001 is provided with a selector valve 3006. The selector valve 3006 switches between a communicating state of the first channel 3001 with the air and a closed state of the same. Moreover, the second channel 3002 connects to a pump 3007 used to force the application liquid and air to flow through the liquid channel 3000 in a desired direction. In this case, a flow of a liquid is generated which is directed from the first channel 3001 to the second channel 3002 via the liquid holding space S.

In this embodiment, the first channel 3001 and the second channel 3002 are formed of cylindrical tubes. An opening formed at an end of each tube is placed at the bottom of the storage tank 3003 or close to the bottom. The position of the opening allows the application liquid in the storage tank 3003 to be completely consumed.

Figure 18:
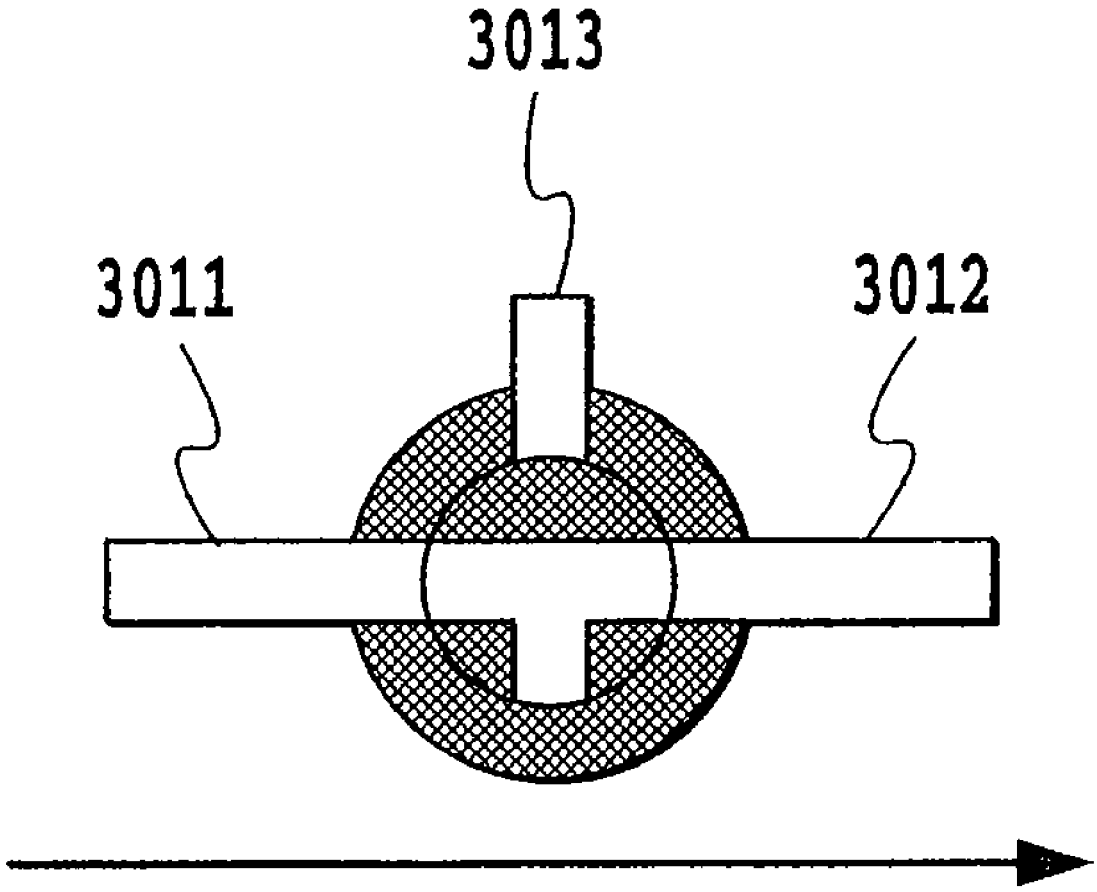
FIG. 18 is a diagram showing a sate that tubes 3011 and 3012 communicate with each other through a three-way valve 3006.
Figure 19:
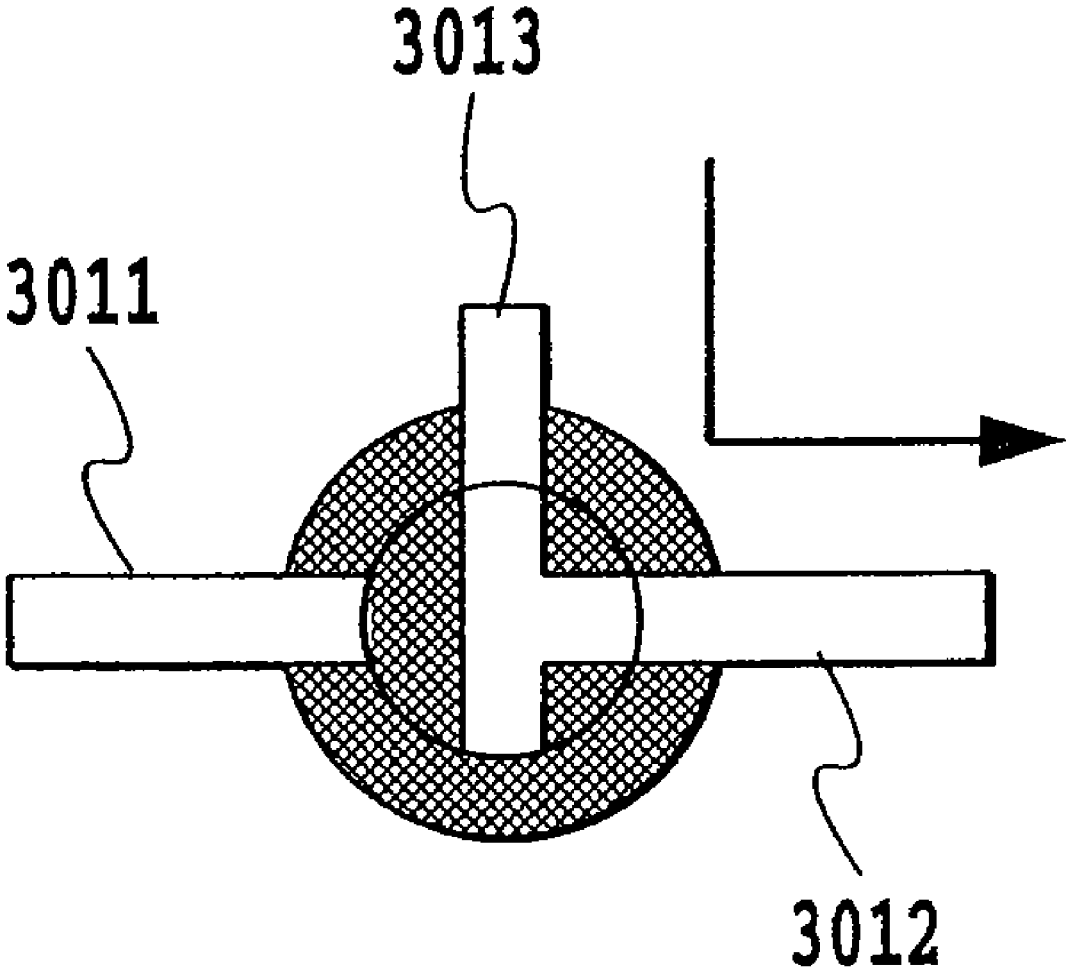
FIG. 19 is a diagram showing a state that a tube 3012 and an air communicating port 3013 communicate with each other through a three-way valve 3006.

According to this embodiment, various types of the selector valves 3006 are applicable provided that they selectively enable and disable the communication between the first channel 3001 and the air. In this case, a three-way valve is used as shown in FIG. 12. The three-way valve 3006 has three ports that are in communication with one another. It is possible to allow two of the three ports to selectively communicate with any two of the storage tank tube 3011 in the first channel 3001, liquid holding member tube 3012 and air communicating port 3013. The three-way valve 3006 is selectively switched between a connected state in which the tubes 3011 and 3012 are in communication with each other and a connected state in which the tube 3012 and the air communicating port 3013 are in communication with each other. This enables the application liquid in the storage tank 3003 or air obtained through the air communicating port 3013 to be selectively supplied to the space S formed by the liquid holding member 2001 and the applying roller 1001. Specifically, while the tubes 3011 and 3012 are in communication as shown in FIG. 18, the application liquid in the storage tank 3003 is supplied to the liquid holding space S. On the other hand, while the tube 3012 and the air communicating port 3013 are in communication as shown in FIG. 19, the air obtained through the air communicating port 3013 is supplied to the liquid holding space S. The switching of the three-way valve 3006 is carried out in accordance with a control signal from a control section 4000 described later. Thus, the application liquid is filled or supplied.

(Control System)

Figure 13:
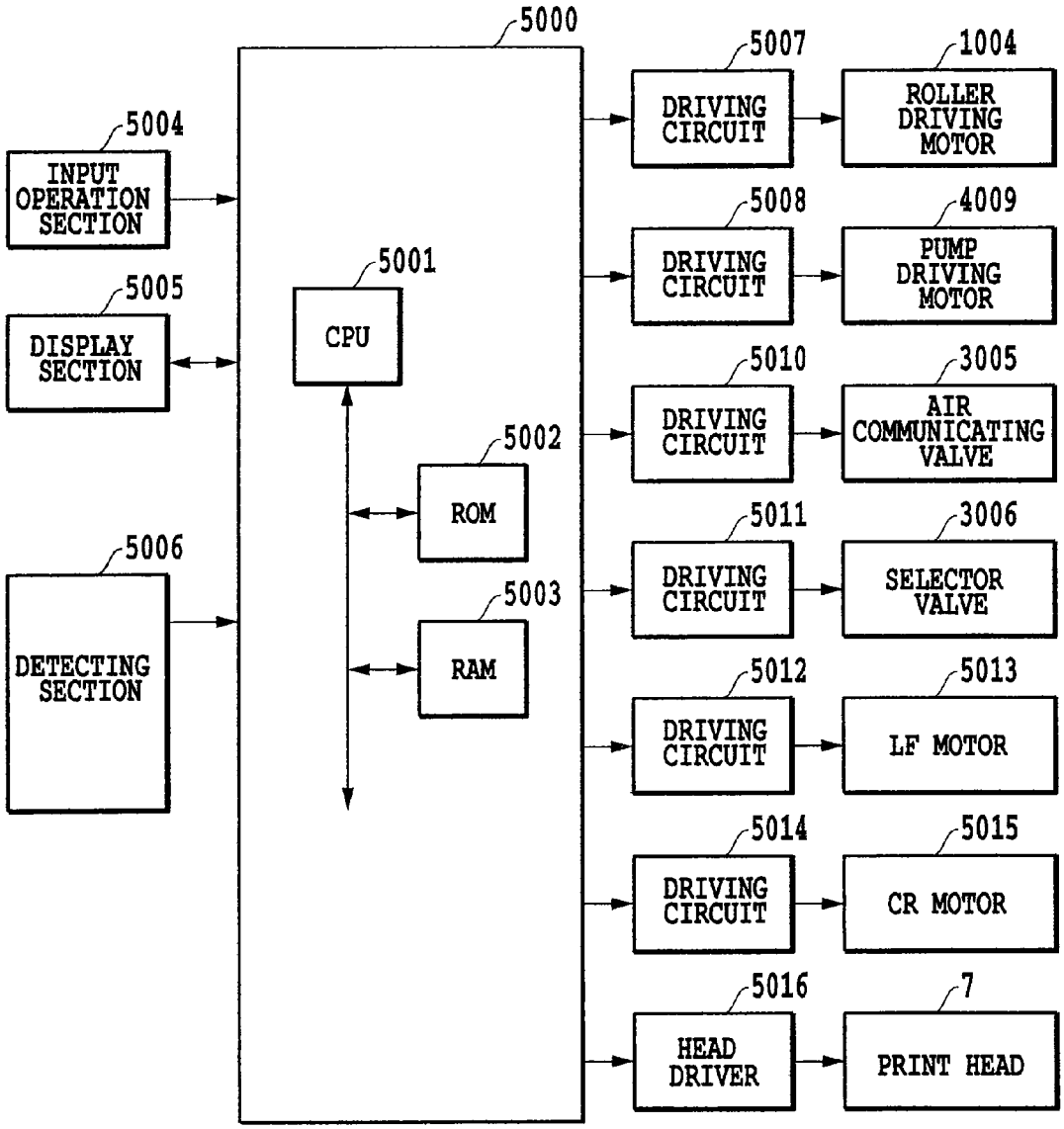
FIG. 13 is a block diagram generally showing the configuration of a control system of the ink jet printing apparatus according to the present invention.

FIG. 13 is a block diagram generally showing the configuration of the control system in the liquid applying apparatus according to the present embodiment.

In FIG. 13, the control section 5000 operates as control means for controlling the whole liquid applying apparatus. The control section 5000 has a CPU 5001 that performs various process operations such as calculations, control, and determinations, a ROM 5002 that stores, for example, control programs for processes executed by the CPU 5001, such as the one described later in FIG. 14, and a RAM 5003 that temporarily stores data used during process operations of the CPU 5001 as well as input data.

The control section 5000 connects to an input operation section 5004 including a keyboard, various switches, or the like with which predetermined instructions or data are input, a display section 5005 that provides various displays including inputs to and the set state of the liquid applying apparatus, and a detecting section 5006 including a sensor or the like which detects the position of a print medium or the operational state of each section. The control section 5000 also connects to the roller driving motor 1004, a pump driving motor 4009, an air communicating valve 3005, and the selector valve 3006, via driving circuits 5007, 5008, 5010, and 5011.

In accordance with a program of a process procedure described later in FIG. 14, a CPU 5001 controls the driving of the elements of the applying mechanism. The CPU 5001 also controls the driving of an LF motor 5013, a CR motor 5015, and the print head 7 which relate to the printing mechanism, via driving circuits 5012 and 5014 and a head driver 5016. That is, driving by the LF motor 5013 rotates the conveying roller 4. Driving by the CR motor moves a carriage on which the printhead 7 is mounted. Moreover, the CPU 5001 performs control such that inks are ejected through the nozzles in the print head.

Figure 14:
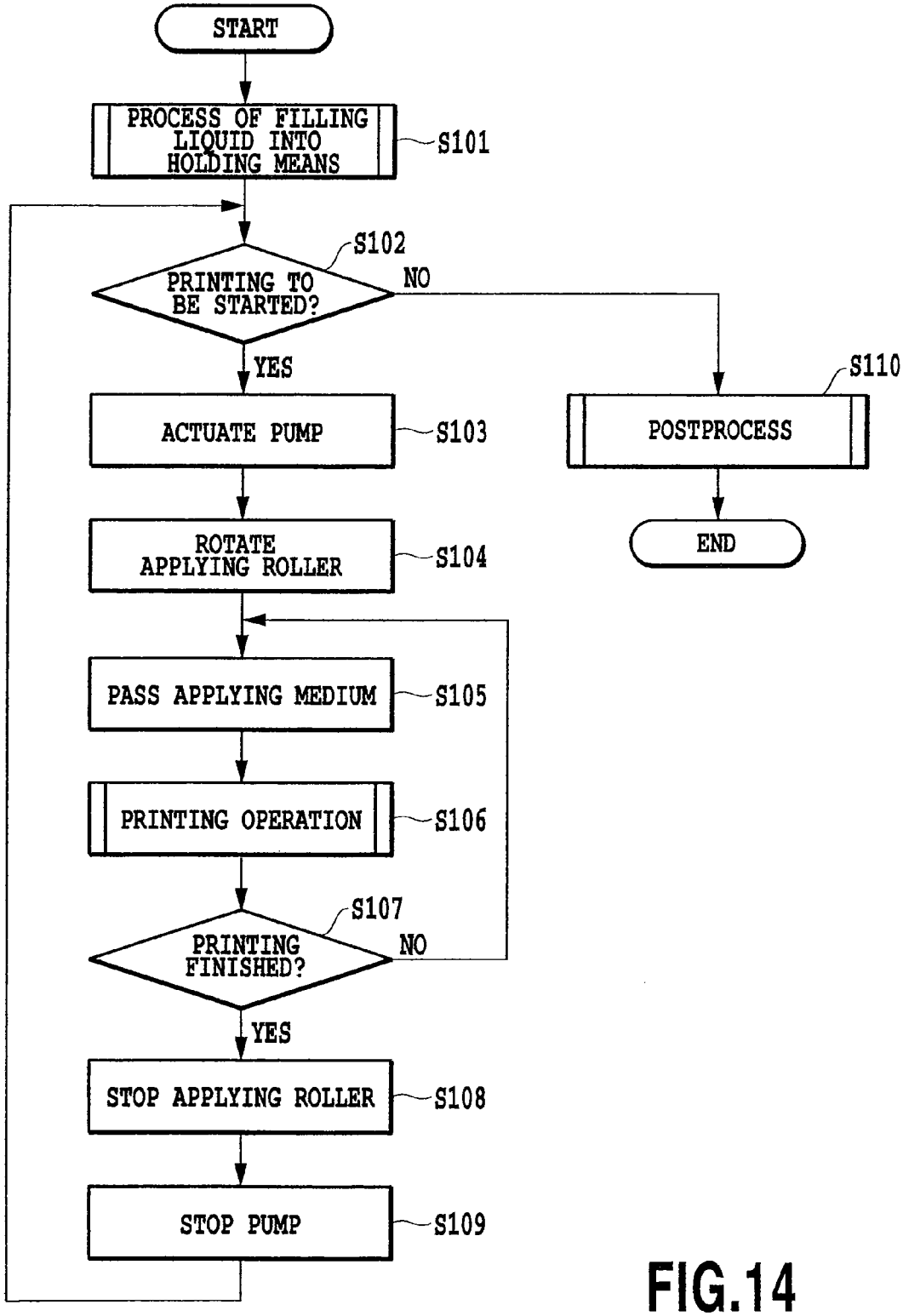
FIG. 14 is a flowchart showing the sequences of an applying operation and a printing operation according to another embodiment of the present invention.

FIG. 14 is a flowchart showing a process procedure for applying a liquid and for a printing operation associated with the application of the liquid in the ink jet printer according to the present embodiment.

When the ink jet printer is powered on, the control section 5000 executes an applying operation and printing operation sequence described below, in accordance with the flowchart shown in FIG. 14.

Filling Step

In step S101 the liquid holding space S is filled with the application liquid. In this filling step, first the air communicating valve 3005 of the storage tank 3003 is opened for a communication with the air, and the pump 3007 is driven for a given length of time. Thus, if the liquid holding space S and the channels 3001 and 3002 have not been filled with the application liquid, the pump drives the air inside the space and channels out to the storage tank 3003. The air is then discharged to the exterior of the apparatus. These portions are then filled with the application liquid. On the other hand, if these portions have already been filled with the application liquid, the application liquid in these portions starts to flow. These portions are thus supplied with an application liquid having an appropriate concentration and viscosity. This initial operation allows the application liquid to be supplied to the applying roller 1001. It is thus possible to apply the application liquid to the print medium.

Applying Step

Figure 10:
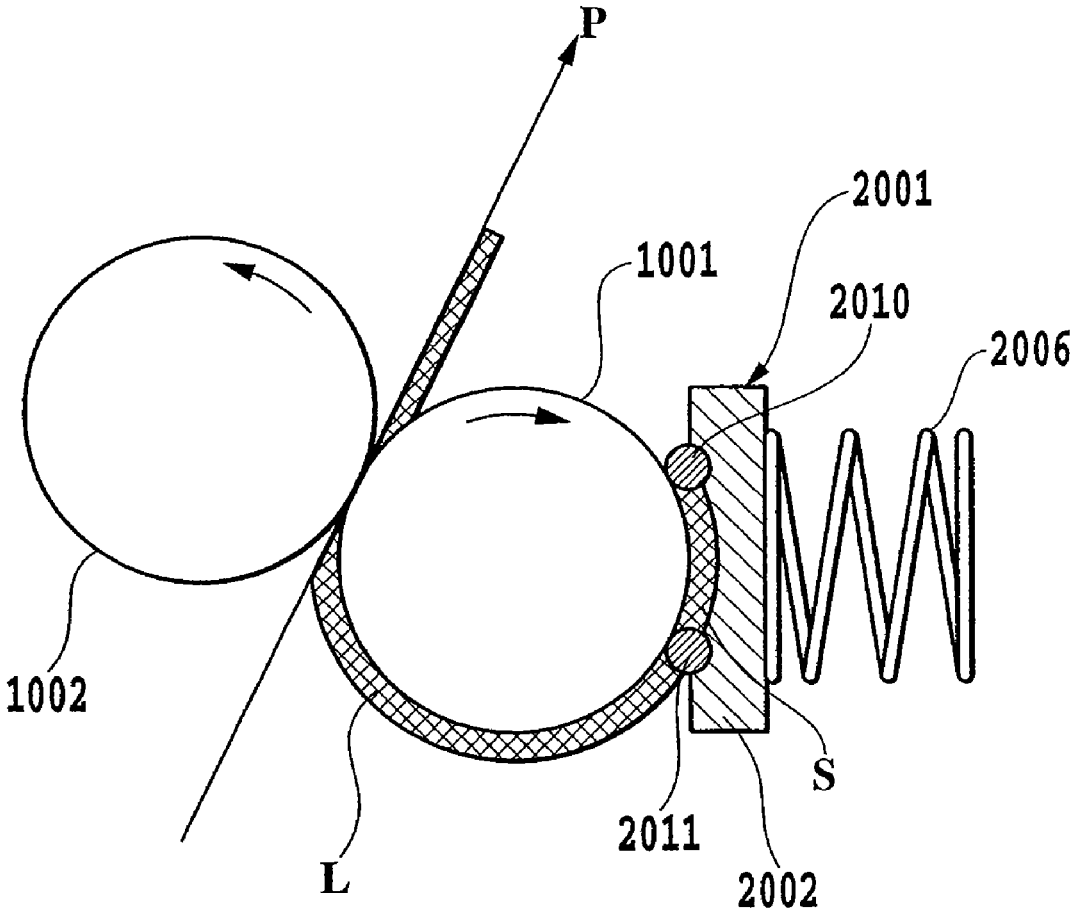
FIG. 10 is a vertical sectional view showing how an application liquid is filled into a liquid holding space formed by the liquid holding member and the applying roller and how a liquid is applied to a print medium by the rotation of the applying roller.

Then, an applying start instruction is input (step S102). Then, the pump 3007 restarts operation (step S103). The applying roller starts rotating clockwise as shown by an arrow in FIGS. 1 and 3 (step S104). Then, as shown in FIG. 10, the rotation of the applying roller 1001 causes the application liquid L filled into the liquid holding space S to slipperily flow between the applying roller l001 and a lower edge 2011 of the abutting member 2009 against the pushing force of the abutting member 2009 of the liquid holding member 2001, which force acts on the applying roller 1001. The application liquid adheres to the outer periphery of the applying roller 1001 in layer form. The application liquid L adhering to the applying roller 1001 is transferred to the abutting portion between the applying roller 1001 and the counter roller 1002.

Then, a print medium supplying mechanism 1006 conveys the print medium to between the applying roller 1001 and the counter roller 1002. The print medium is inserted between these rollers and conveyed to a sheet discharging section as the applying roller 1001 and the counter roller 1002 rotate (step S105).

During this conveyance, the application liquid applied to the peripheral surface of the applying roller is transferred from the applying roller 1001 to the print medium P as shown in FIG. 10. Of course, means for supplying a print medium to between the applying roller 1001 and the counter roller 1002 is not limited to the above supplying mechanism. It is possible to use any means, for example, manual means which uses a predetermined guide member or which is solely used.

In FIG. 10, an area with crossing oblique lines denote the application liquid L. In this case, the application liquid on the applying roller 1001 and the print medium P is shown considerably thicker than the actual one in order to clearly illustrate how the application liquid L is applied.

As described above, an applied part of the print medium P is conveyed in the direction of the arrow under the conveying force of the applying roller 1001. Further, an unapplied part of the print medium P is conveyed to the contact portion between the print medium P and the applying roller 1001. This operation is continuously or intermittently performed to apply the application liquid to the entire print medium.

FIG. 10 shows the ideal applied state in which the all of the application liquid L adhering to the applying roller 1001 after slipperily flowing out of the abutting member 2009 is transferred to the print medium P. However, actually, not all of the application liquid L adhering to the applying roller 1001 is not transferred to the print medium P. Specifically, when the print medium P conveyed separates from the applying roller 1001, the application liquid L often also adheres to and remains on the applying roller 1001. The amount of application liquid L remaining on the applying roller 1001 varies depending on the material of the print medium P or the state of fine concaves and convexes on the surface of the print medium P. However, if the print medium P is ordinary paper, the application liquid L remains on the peripheral surface of the applying roller 1001 after an applying operation.

Figure 15:
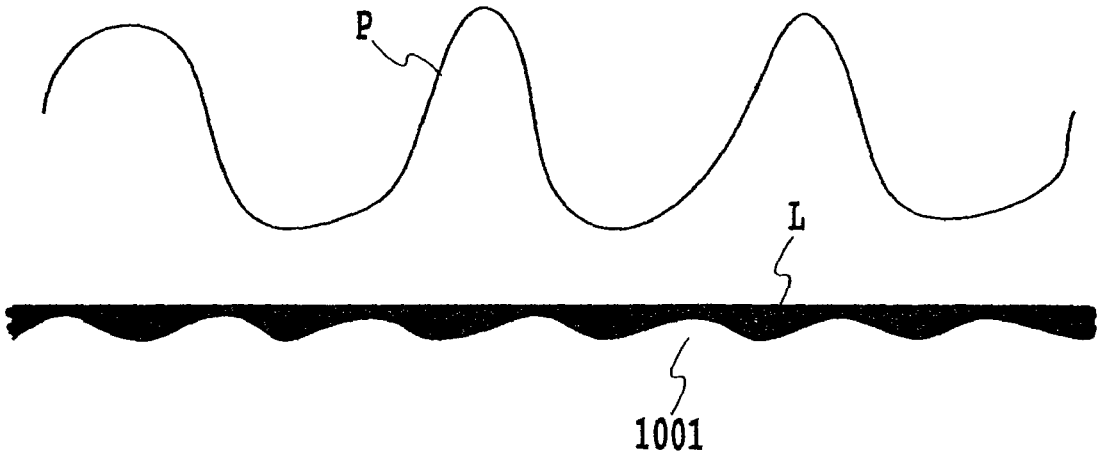
FIG. 15 is a diagram illustrating an applying process executed on a surface of a medium P as an ordinary paper and the applying surface of a roller.
Figure 16:
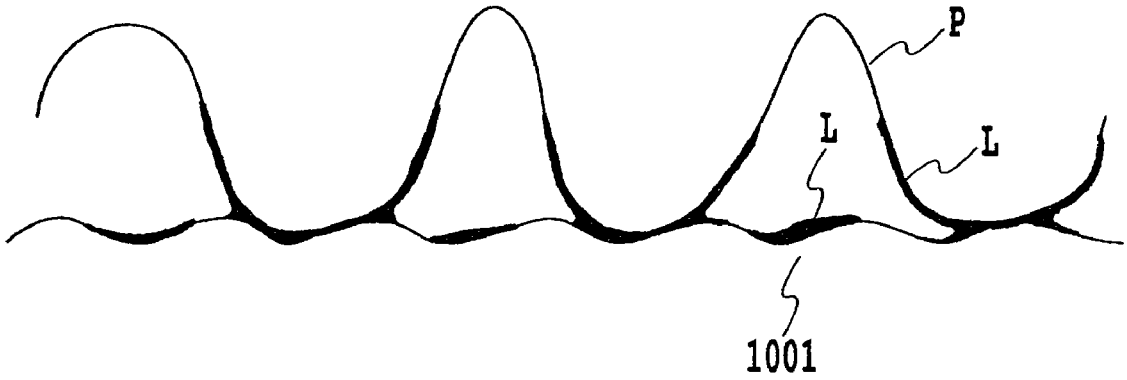
FIG. 16 is a diagram illustrating an applying process executed on a surface of a medium P as an ordinary paper and the applying surface of a roller.
Figure 17:
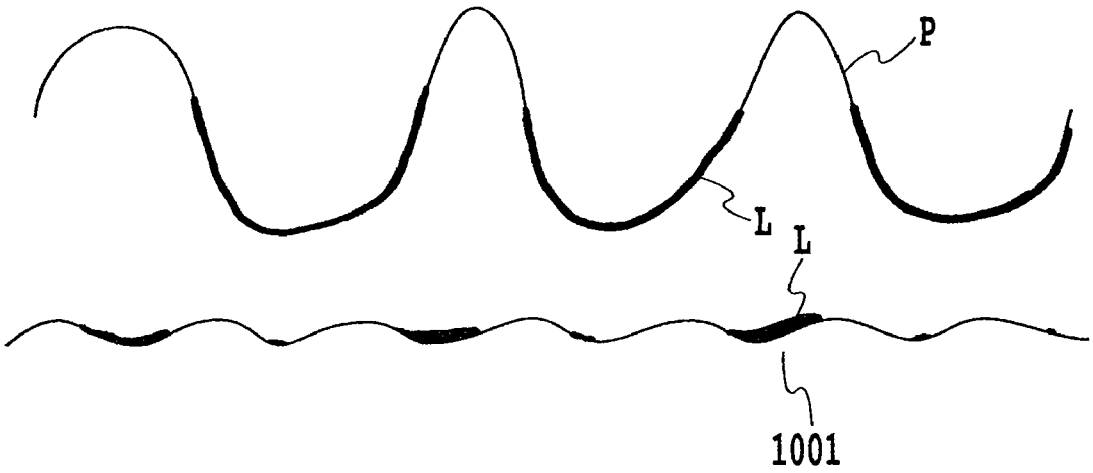
FIG. 17 is a diagram illustrating an applying process executed on a surface of a medium P as an ordinary paper and the applying surface of a roller.

FIGS. 15, 16, and 17 are diagrams illustrating the process of applying between a surface of the medium P and an applying surface in the case where the medium is ordinary paper. In these figures, the liquid is painted over with black.

FIG. 15 shows the state of the upstream side of the nip portion between the applying roller 1001 and the counter roller 1002. In this figure, the liquid adheres to the applying surface of the applying roller 1001 so as to slightly cover the fine irregularities (concaves and convexes) on the applying surface.

FIG. 16 shows the state of the surface of ordinary paper, the medium P, and the applying surface of the applying roller 1001, at the nip portion between the applying roller 1001 and the counter roller 1002. In this figure, the convexes on the surface of the ordinary paper, the medium P, contact with the applying surface of the applying roller 1001. The liquid instantaneously permeates through or sticks to fibers in the surface of the ordinary paper, the medium P, through the contacting parts. The liquid adhering to those parts of the applying surface of the applying roller which do not contact with the convex portions on the surface of the ordinary paper remains on the applying surface.

FIG. 17 shows the state of the downstream side of the nip portion between the applying roller 1001 and the counter roller 1002. In this figure, the medium has completely left the applying surface of the applying roller 1001. The liquid adhering to those parts of the applying surface of the applying roller 1001 which do not contact with the convex portions on the surface of the ordinary paper remains on the applying surface. The liquid on the contacting parts also remains with very small amount on the applying surface.

The application liquid remaining on the applying roller 1001 slipperily flows between the applying roller 1001 and the upper edge 2010 of the abutting member 2009 and returns to the liquid holding space S, against the pushing force of the abutting member 2009 of the liquid holding member 2001, which force acts on the applying roller 1001. The application liquid is then mixed with the application liquid filled into the space S.

Figure 11:
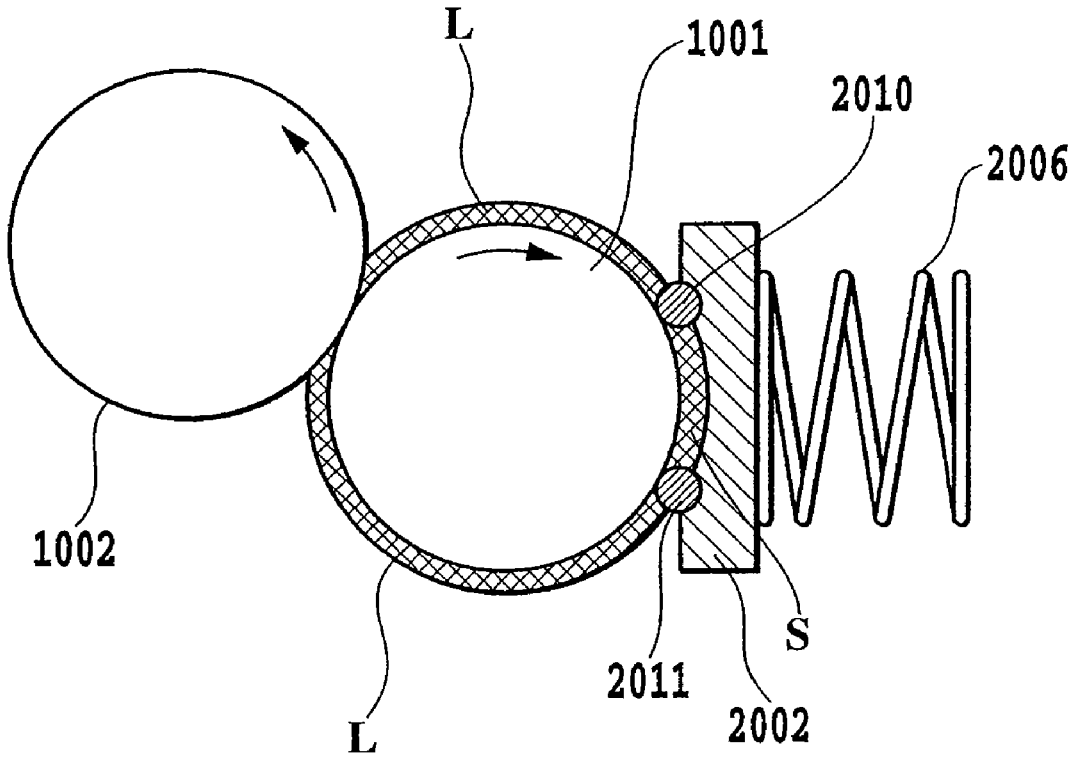
FIG. 11 is a vertical sectional view showing how the application liquid is filled into the liquid holding space formed by the liquid holding member and the applying roller and how the applying roller is rotated when no print medium is present.

The operation of returning the application liquid is similarly performed if the applying roller 1001 is rotated while no print medium is present as shown in FIG. 11. That is, the application liquid adhering to the outer periphery of the applying roller 1001 as a result of the rotation of the applying roller 1001 slipperily flows through the abutting portion between the applying roller 1001 and the counter roller 1002. After flowing through the abutting portion, the application liquid is separated into two parts directed to the applying roller 1001 and the counter roller 1002, respectively. The application liquid remains on the applying roller 1001. Then, the application liquid adhering to the applying roller 1001 slipperily flows between the upper edge 2010 of the abutting member 2009 and the applying roller 1001 to enter the liquid holding space S. The application liquid is then mixed with the application liquid filled into the space S.

Printing Step

After the above described applying steps, a printing operation is performed on a print medium having the application liquid applied to desired parts of the medium (step S106). That is, the print head 7 is scanned over the print medium P conveyed by the conveying roller 4 by a predetermined amount at a time. During the scan, inks are ejected from the nozzles in accordance with print data so as to be applied to the print medium to form dots. The applied inks react with the application liquid, thus improving the concentration and preventing bleeding. The conveyance of the print medium and the scanning of the print head are repeated to print the print medium P. The print finished medium is discharged onto the sheet discharging tray 10.

More specifically, the applying roller intermittently rotates for each predetermined rotation amount so that the application of the liquid is sequentially executed for different applying areas on the print medium, and the conveying roller that conveys the print medium similarly intermittently rotates for each predetermined rotation amount so that printing is sequentially executed for different ink ejection areas on the print medium. This operation can cause the applying roller to be used to apply liquid to second area on an upstream side of the print medium in a conveying path of the print medium, when the print head is used to eject ink to a first area on the down stream side of the same print medium in the conveying path. In this case, each intermittent conveying amount by the applying roller is the same as that by the conveying roller. In this configuration, a length from the applying roller to the print head in a conveying path for conveying the print medium, to which the liquid has been applied by means of the applying roller, to a location to which the print head is opposed, is shorter than maximum length of the print medium that can be used in the printer.

In the present embodiment, as the liquid is applied to the print medium, printing is sequentially executed on parts of the print medium to which the liquid has already been applied. That is, the conveying path from the conveying roller to the printhead is shorter than the print medium, and when a part of the print medium to which the liquid has already been applied reaches the scan area of the print head, the applying mechanism applies the liquid to another part of the print medium. Every time the print medium is conveyed by a predetermined amount, liquid application and printing are sequentially executed on different parts of the print medium. However, in an alternative form of application of the present invention, printing may be carried out after one sheet of print medium has been completely applied with the application liquid as described in Japanese Patent Application Laid-open No. 2002-96452.

Ending Step

Once the applying operation has been performed on the print medium, it is determined whether or not to end the applying step (step S107). When the applying step is not to be ended, the process returns to step S105 to repeat the applying operation until the applying step is executed on the entire area of the print medium which must be applied. Once the printing step has been ended, the applying roller 1001 is stopped (step S108), and the driving of the pump 3007 is stopped (step S109). Subsequently, the process shifts to step S102 to repeat the previously described operations in steps S102 to S109, if the print start instruction has been input. If the print start instruction has not been input though a predetermined time period elapses, a post-process, which includes a collecting operation of collecting the application liquid from the liquid holding space S and liquid channel (step S110). Thus, the processing is finished.

Collecting Operation

Next, with reference to FIG. 20, description will be given of an application liquid collecting operation as a part of the post-process of step S110. The collecting operation is performed by opening the air communicating valves 3005 and 3013 and driving the pump 3007 to cause the application liquid in the tube 3012 of the first channel 3001, the liquid holding space S, and the second channel 3002 to flow into the liquid storing tank 3003. This operation will be described below in detail.

Immediately before the collecting operation is started, the applying roller 1001 and the pump 3007 are in a stopped state. Further, the air communicating valve 3005 is in an opened state, and then the air communicating port 3004 is in a communicating state for the air.

Figure 20:
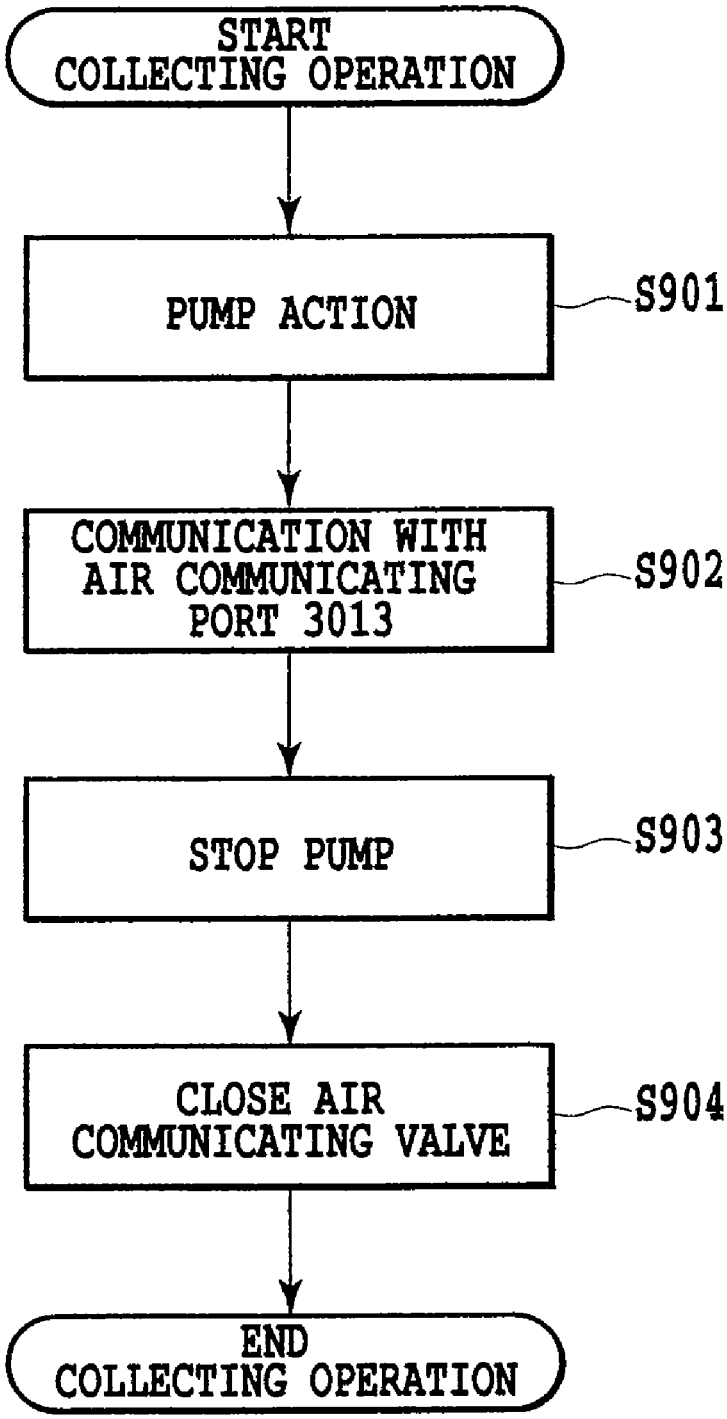
FIG. 20 is a flowchart showing the sequence of a collecting operation.

When the collecting operation is started, the pump 3007 is operated in step S901 in FIG. 20 to cause the application liquid to flow in the liquid channel 3000. For example, in the second channel 3002, the application liquid flows in a direction shown by an arrow in FIG. 12.

Then, in step S902, the three-way valve 3006 is set as shown in FIG. 19 to cause the air communicating port 3013 and the liquid holding member side tube 3012 to communicate with each other. Then, since the operation of the pump 3007 has caused the application liquid to flow in the direction shown by the arrow in FIG. 12, air flows in through the air communicating port 3012 together with the flow of the application liquid. This makes the application liquid present in a path (referred to as a liquid path A below), which extends from the liquid holding member tube 3012 to the second channel 3002 and including the liquid holding space S, collected into the storage tank 3003. Further, the liquid path A is filled with air. In this state, the three-way valve 3006 has been set as shown in FIG. 19 and the storage tank tube 3011 is thus shut off from the air.

Then, in step S903, the operation of the pump 3007 is stopped, and the pump 3007 is used to shut off the second channel 3002 from the air. Finally, in step S904, the air communicating valve 3005 is closed.

With the above collecting operation, the application liquid is collected from the liquid path A if the applying operation is not performed for a predetermined period. This inhibits the application liquid from being evaporated and fixed in the liquid holding space S in the liquid path A even if the applying operation is not performed a long time. This in turn prevents defective applying caused by the fixture of the application liquid to the abutting member 2009.

Further, the collecting operation can prevent the application liquid from evaporating from the liquid holding space S. After the collecting operation, the storage tank 3003 is shut off from the air by closing the air communicating valve 3005 and switching the selector valve 3006 to block the communication between the storage tank tube 3011 and the air communicating port 3013. It is thus possible to prevent the application liquid from evaporating from the storage tank 3003 and from flowing out if the apparatus is tilted during movement, transportation, or the like.

In addition, the process described for the flowchart shown in FIG. 14, in step S 109, once stops the pump 3007 and then, if the print start instruction has not been inputted though the predetermined time period elapses, moves to the collecting step of step S 110. The present invention is not limited to be embodied in this form. For example, the process may move from the applying roller stopping step of S 108 in FIG. 14 to an operation of step S 902 in FIG. 20, without stopping the pimp 3007 of step 109 in FIG. 14.

In this form, if the print start instruction has been inputted after the printing operation of step S 107 in FIG. 14 is finished, the process moves to step S 104. On the other hand, if no printing instruction is given during the predetermined period, the process shifts to step S108 to stop the applying roller. In this stopping the roller, since the pump 3007 remains operating, the process skips step S 901 in FIG. 20 to move to step S 902 to start the collecting operation of the applying liquid. Then, similarly to the above, the process goes through steps S 903, S 904 to finish the collecting operation of the applying liquid.

This embodiment employs the applying roller of a material: EPDM of Rubber Hardness Degrees 30, a surface roughness: Ra 1.6 μm, and diameter: 22.19 mm. The counter roller is of a material: aluminum, a surface: mirror finish, and a diameter: 22.19 mm. Further, the abutting member of liquid holding member is of a material: NBR of slidable grade provided by NOK and Rubber Hardness Degrees 70, and a diameter: 3 mm.

Another Embodiment

In the above embodiments, the abutment of the liquid holding member and counter roller on the applying roller is not cleared after the application liquid has been collected. However, the abutment may be cleared after the collecting. In this case, the collecting operation of the held applying liquid is performed. Alternately, the collecting operation is not always performed. In the case that long period contacting of the applying liquid with the applying roller and the like does not affect them, and the applying liquid is not degraded, the applying liquid remains held without the collecting operation. Further, the present invention is not limited to the clearing of the abutment, that is, separation. Specifically, the force exerted for the abutment may be weakened instead of separating the liquid holding member and counter roller from the applying roller.

Moreover, the applying member transferring and applying the application liquid held in the liquid holding member to the print medium is not limited to the applying roller. The applying member may be a belt-like member such as an endless belt. In this case, at portions of the belt where the liquid holding member, counter roller and the like contact with the belt, the clearing of abutment may be performed to suppress the deformation of the abutment portions.

Yet Another Embodiment

In the above embodiments, by way of example, the liquid is applied in the ink jet printing-based printing apparatus. However, the present invention is applicable to printing apparatuses based on other systems. For example, the degree of whiteness of the medium can be improved by using a liquid containing a fluorescent whitening agent as an application liquid. Further, as a further applying liquid, a liquid containing a component to suppress a curl of the applying medium (phenomenon that a medium bends to form a curvature) may be employed. The printing means used after the liquid application is not limited to the ink jet printing system. Effects can be produced using a printing system such as a thermal transfer system or an electro-photographic system. Alternatively, in a silver photography-based printing apparatus, a photosensitive agent may be applied as an application liquid before printing.

The present invention has been described in detail with respect to preferred embodiments, and it will now be apparent from the foregoing to those skilled in the art that changes and modifications may be made without departing from the invention in its broader aspects, and it is the intention, therefore, that the appended claims to cover all such changes and modifications as fall within the true spirit of the invention.

This application claims priority from Japanese Patent Application No. 2004-035802 field Feb. 12,2004, Which is hereby incorporated by reference herein.

What is claimed is:

1. An ink jet printing apparatus comprising:

an applying unit that comprises an applying member configured to apply a liquid which reacts with an ink to a printing medium and a holding member abutting with said applying member so as to form a liquid holding space configured to hold the liquid, said applying unit applying the liquid in the liquid holding space to the printing medium by rotating said applying member, the liquid including a component which insolubilizes or coagulates a color material in the ink;

a storage unit configured to store the liquid;

a first path configured to supply the liquid from said storage unit to the liquid holding space;

a second path configured to return the liquid to said storage unit from the liquid holding space;

a pump configured to generate a flow of the liquid in said first path, the liquid holding space and said second path; and a print head configured to eject the ink to the printing medium, to which the liquid in the liquid holding space has been applied by said applying member, wherein said pump is located at said second path.

2. An ink jet printing apparatus comprising:

an applying roller configured to apply a liquid which reacts with an ink to a printing medium;

a holding member abutting with said applying roller so as to form a liquid holding space configured to hold the liquid to be applied by said applying roller;

a storage unit configured to store the liquid;

a first path configured to supply the liquid from said storage unit to the liquid holding space;

a second path configured to return the liquid to said storage unit from the liquid holding space;

a pump configured to generate a flow of the liquid in said first path, the liquid holding space and said second path; and a print head configured to eject the ink to the printing medium, to which the liquid in the liquid holding space has been applied by said applying roller, wherein a surface of said applying roller has substantially no irregularities.

3. An ink jet printing apparatus comprising:

an applying roller configured to apply a liquid which reacts with an ink to a printing medium;

a holding member abutting with said applying roller so as to form a liquid holding space configured to hold the liquid to be applied by said applying roller;

a storage unit configured to store the liquid;

a first path configured to supply the liquid from said storage unit to the liquid holding space;

a second path configured to return the liquid to said storage unit from the liquid holding space;

a pump configured to generate a flow of the liquid in said first path, the liquid holding space and said second path; and a print head configured to eject the ink to the printing medium, to which the liquid in the liquid holding space has been applied by said applying roller, wherein a surface of said applying roller is provided with no pattern of an image to be printed with the ink.

4. An ink jet printing apparatus comprising:

an applying roller configured to apply a liquid which reacts with an ink to a printing medium, the liquid including a component which insolubilizes or coagulates a color material in the ink;

a holding member abutting with said applying roller so as to form a liquid holding space configured to hold the liquid to be applied by said applying roller;

a storage unit configured to store the liquid;

a first path configured to supply the liquid from said storage unit to the liquid holding space;

a second path configured to return the liquid to said storage unit from the liquid holding space;

a pump configured to generate a flow of the liquid in said first path, the liquid holding space and said second path; and a print head configured to eject the ink to the printing medium, to which the liquid in the liquid holding space has been applied by said applying roller, wherein said pump is located at said second path, and wherein a surface of said applying roller is provided with no pattern of an image to be printed with the ink.

5. The ink jet printing apparatus according to claim 4, wherein said pump is driven to supply the liquid from said storage unit to the liquid holding space through said first path.

6. The ink jet printing apparatus according to claim 4, wherein said pump is driven to return the liquid in said first path, the liquid holding space and said second path to said storage unit.

7. The ink jet printing apparatus according to claim 4, herein said pump is driven to circulate the liquid in a circulation channel including said storage unit, said first path, the liquid holding space and said second path.

* * * * *